US011472612B2

(12) United States Patent
Choi et al.

(10) Patent No.: US 11,472,612 B2
(45) Date of Patent: Oct. 18, 2022

(54) DROPPER DISPENSERS AND METHODS OF USING THE SAME

(71) Applicant: Silgan Dispensing Systems Corporation, Richmond, VA (US)

(72) Inventors: Daniel Choi, Richmond, VA (US); Alejandro Espinoza, Overland Park, KS (US); Leah Flynn, Grandview, MO (US); Sara Jane Falcon, Richmond, VA (US); Jacqueline Jennette, Grandview, MO (US); Jeroen Regt, Waalwijk (NL)

(73) Assignee: Silgan Dispensing Systems Corporation, Richmond, VA (US)

( * ) Notice: Subject to any disclaimer, the term of this patent is extended or adjusted under 35 U.S.C. 154(b) by 0 days.

(21) Appl. No.: 17/262,715

(22) PCT Filed: Jul. 8, 2019

(86) PCT No.: PCT/US2019/040804
§ 371 (c)(1),
(2) Date: Jan. 23, 2021

(87) PCT Pub. No.: WO2020/027987
PCT Pub. Date: Feb. 6, 2020

(65) Prior Publication Data

US 2021/0229879 A1 Jul. 29, 2021

Related U.S. Application Data

(60) Provisional application No. 62/713,694, filed on Aug. 2, 2018.

(51) Int. Cl.
*A45D 34/04* (2006.01)
*B01L 3/02* (2006.01)
(Continued)

(52) U.S. Cl.
CPC ..... *B65D 47/18* (2013.01); *A45D 34/04* (2013.01); *A45D 40/26* (2013.01); *B01L 3/0282* (2013.01)

(58) Field of Classification Search
CPC ..... B01L 3/0282; B65D 47/18; A45D 40/26; A45D 34/04
See application file for complete search history.

(56) References Cited

U.S. PATENT DOCUMENTS 4,768,682 A 9/1988 Friedrich
5,464,048 A 11/1995 Allen
(Continued)

FOREIGN PATENT DOCUMENTS

CN 102595963 A 7/2012
CN 204568339 U 8/2015
(Continued)

OTHER PUBLICATIONS

European Extended Search Report, EP19844464.8, dated Jul. 5, 2022.

*Primary Examiner* — Patrick M. Buechner
(74) *Attorney, Agent, or Firm* — Barlow, Josephs & Holmes, Ltd.; Stephen J. Holmes

(57) ABSTRACT

Embodiments of the invention related to dispensing devices (100), and more particularly to dispensing devices having a dropper or dispenser (200) associated with a container (900) full of product wherein the dropper (200) may be charged, separated from the container (900), and then used to dispense a product therefrom.

10 Claims, 11 Drawing Sheets

(51) Int. Cl.
*B65D 47/18* (2006.01)
*A45D 40/26* (2006.01)

(56) References Cited

U.S. PATENT DOCUMENTS

| | | | | |
|---|---|---|---|---|
| 2005/0070853 | A1* | 3/2005 | Gatton | A61J 7/0046 604/195 |
| 2011/0284123 | A1 | 11/2011 | Bouix et al. | |
| 2013/0074983 | A1 | 3/2013 | Choi | |
| 2017/0043918 | A1 | 2/2017 | Guo | |
| 2017/0082475 | A1 | 3/2017 | Ham et al. | |
| 2017/0231365 | A1* | 8/2017 | Choi | A45D 34/04 222/383.1 |
| 2018/0042363 | A1 | 2/2018 | Kim | |

FOREIGN PATENT DOCUMENTS

| | | | | |
|---|---|---|---|---|
| CN | 206218460 | U | * | 6/2017 |
| CN | 107000922 | A | | 8/2017 |
| KR | 1020130062124 | A | | 6/2013 |

* cited by examiner

DROPPER DISPENSERS AND METHODS OF USING THE SAME

BACKGROUND OF THE INVENTION

Field of the Invention: The present invention relates to dispensing devices and more particularly to novel embodiments of dropper dispensers.

State of the Art Dispensers are used in many different applications to dispense liquid products such as creams, lotions, oils, and other products for use in personal and beauty care applications. Dispensers are also used in other applications to dispense liquid or fluid products for various uses.

In the personal and beauty care application space, dispensers are often used to dispense products used on a user's skin, such as make-up products, beauty enhancers, serums, and other liquids. In some instances, such products may be dispensed with a conventional bulb-dropper dispenser. Conventional bulb-droppers generally include a flexible bulb attached to one open end of a rigid tube. To use such a device, a user may squeeze the bulb and insert the opposite open end of the rigid tube into a liquid or fluid product and release the bulb. Upon release of the bulb, a vacuum is formed, resulting in the drawing of liquid into the ridged tube. To dispense the liquid from the rigid tube, the user may again squeeze the bulb, forcing the liquid or fluid out of the rigid tube and onto a desired surface such as the user's skin, a cloth, or other substrate. Conventional bulb-droppers have also been adapted for use with containers or bottles such that the bulb-dropper also includes a collar capable of being attached to a container or bottle for storage and shipping.

While the use of conventional bulb-droppers is widespread and they are relatively cheap to produce and incorporate with products, there are issues that exist with such bulb-droppers. For example, in some instances, the use of the bulb is not very controlled and is user dependent, resulting in inconsistent results if dosing is important. In addition, a bulb may be filled with product inadvertently by squeezing the bulb too hard or by squeezing and filling a tube multiple times. Product also adheres to the outer surface of the rigid tube, occasionally resulting in product dripping off of the outer surface in an uncontrolled manner rather than being dispensed in a controlled manner. In addition, when excessive product coats an outer surface of the rigid tube, setting the bulb-dropper down outside of its case or the container or bottle to which it was attached may result in unwanted transfer of product to the surface on which it is set or may result in contaminants attaching to the rigid tube and being transferred into the container or bottle to which the bulb-dropper is attached.

In addition, consumers regularly have issues with such conventional bulb-droppers. Some of the concerns or problems faced by consumers include issues with inconsistent control of the dispensing function of such bulb-droppers, unsanitary conditions associated with use of the dropper, mess resulting from excess fluid on parts of the dropper, and other issues.

As a result, there is a need for an improved dispenser or dispensing system capable of dispensing liquids and fluids.

BRIEF SUMMARY OF THE INVENTION

According to certain embodiments of the invention, a dispensing system may include a container, a collar attached to the container, and a dropper attached to the collar wherein the dropper may be charged and removed from the collar for dispensing product charged in the dropper. The dispensing system may include an atmospheric or an airless system.

In some embodiments, a dropper may be actuated by applying a force to an actuator of the dropper. Continued application of force to the actuator may move a portion of the collar. As the force is released the dropper is charged with a dose of product from an interior of the container and the collar releases the dropper from its collar connection. A user may then remove the dropper and actuate the dropper to dispense the produce contained therein. The dropper may then be reattached to the collar for continued use.

In other embodiments, a dispensing system may include an airless system wherein a tube associated with the dropper is shortened such that it pulls product off of a top of a product surface in a container. The dropper may sit in a collar attached to the container, wherein the collar includes a valve seat having a valve or valve system attached thereto to allow a one-way flow of product out of the container. When the dropper is attached to the collar and actuated, the dropper product space or fluid chamber and tube interior are evacuated and then filled with product through the valve. A piston follower in the container moves to replace the volume of product withdrawn from the container. A user may then detach the dropper and dispense the product contained therein by actuating the dropper. The dropper may be replaced or reattached to the collar and reused until the product has been evacuated from the container.

According to other embodiments of the invention, a dropper may include a tube that is substantially as long as the container. A collar seated in the container may include a tube sleeve extending nearly to the bottom of the container. A container piston may be positioned around the tube sleeve to act as an airless piston within the container. An end of the tube sleeve adjacent the container bottom may include a valve seat having a valve or valve system connected thereto. When the tube of a dropper is seated adjacent the valve seat and actuated, the vacuum formed in the tube and dropper draws product into the dropper. The container piston then moves downwards replacing the volume of product removed by the dropper. The dropper may then be removed from the collar and used to dispense the product by a user.

Other embodiments of the invention include dispensing systems having a container with a tip at one end and an opening at the other end. A product dispenser may be inserted into the opening of the container until it engages the tip. An actuator associated with the product dispenser may be actuated to force product contained in the product dispenser through the tip such that it is dispensed from the dispensing system.

According to some embodiments; a dispensing system may have a dual flanged plug valve which may partially seat against a wall of a plug to allow gravity to flow product into a volume or space defined by the dual flanges and the wall. Movement of the plug valve caused by actuation of the dispensing system may seal both flanges against a wall to define a volume or dose of product. Continued movement of the dual flanges may disengage a flange such that the product contained in the volume or dose may be dispensed from the dispensing system.

In other embodiments of the invention, a dispenser having a dropper tube may be connected to a collar and container. Actuation of the dispenser may be accomplished by applying a force to the dispenser and pushing it towards the container. As the dispenser is actuated; product flows into the tube of the dispenser. In some embodiments, the product may then be release or dispensed by releasing the force on the dispenser. In other embodiments, product remains in the tube when the force on the dispenser is released; a second actuation of the dispenser is required to dispense the product from the dispenser.

BRIEF DESCRIPTION OF THE DRAWINGS

While the specification concludes with claims particularly pointing out and distinctly claiming particular embodiments of the present invention, various embodiments of the invention can be more readily understood and appreciated by one of ordinary skill in the art from the following descriptions of various embodiments of the invention when read in conjunction with the accompanying drawings in which:

DETAILED DESCRIPTION OF THE INVENTION

Figure 1:
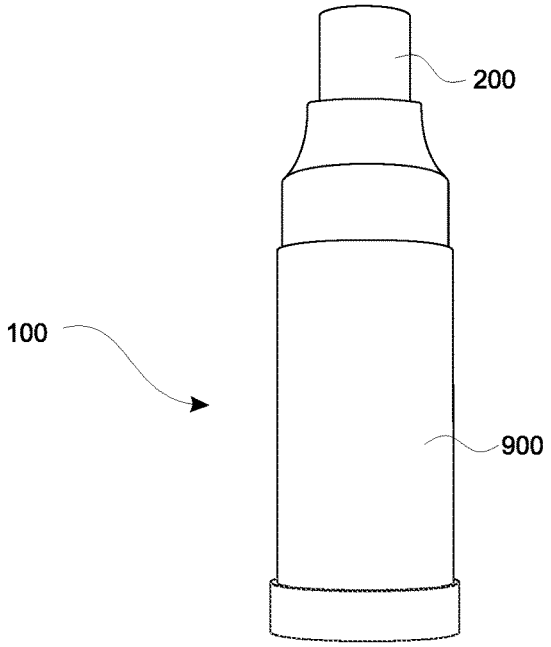
FIG. 1 illustrates a dispensing system according to various embodiments of the invention.
Figure 2:
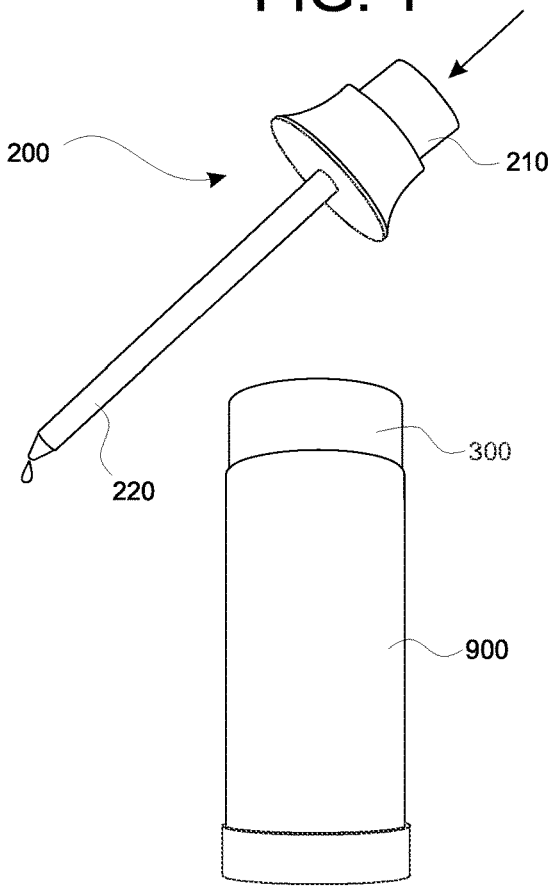
FIG. 2 illustrates a dispenser associated with the dispensing system according to various embodiments of the invention.

According to particular embodiments of the present invention, a dispensing system 100 may include a container 900 or bottle holding a product and a dropper 200 attached to the container 900. In certain embodiments, a dropper 200 may include an actuator 210 and a tube 220 as illustrated in FIG. 2. A dispensing system 100 may also include a collar 300 configured to allow or facilitate attachment of the dropper 200 to the container 900 or interaction between the dropper 200 and an interior of the container 900.

Figure 3:
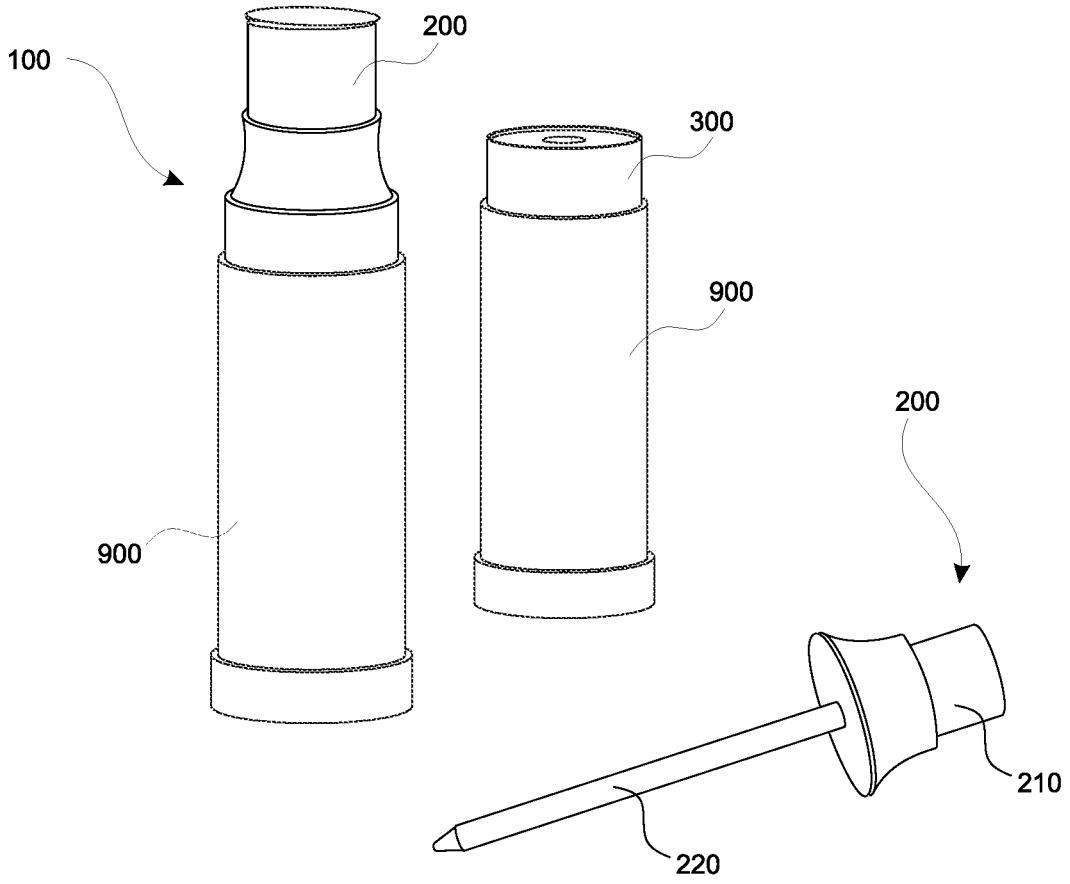
FIG. 3 illustrates an assembled dispensing system and a disassembled dispensing system according to various embodiments of the invention.

FIG. 3 illustrates two dispensing systems 100 according to certain embodiments of the invention, A first dispensing system 100 is in a closed or packaged state with the dropper 200 seated with the collar 300 which is attached to the container 900. In the second image, the same dispensing system 100 is shown with the dropper 200 separated from the collar 300 and container 900 with a product contained in a portion of the tube 220. In this state, the dropper 200 may be actuated to dispense the product contained in the tube 220 onto a desired surface such as skin.

Figure 4:
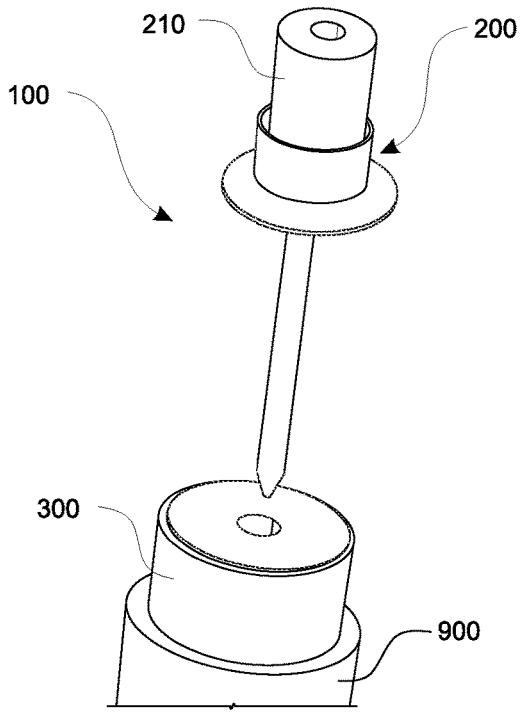
FIG. 4 illustrates a perspective view of a dispenser and container of a dispensing system according to various embodiments of the invention.

FIGS. 4, 5, and 6A through 9B illustrate various configurations of a dispensing system 100 along with particular components of a dropper 200 and collar 300 according to various embodiments of the invention. As illustrated in FIG. 4, a dropper 200 may be separated from a collar 300 and container 900 such that a product may be distributed from the dropper 200.

Figure 5:
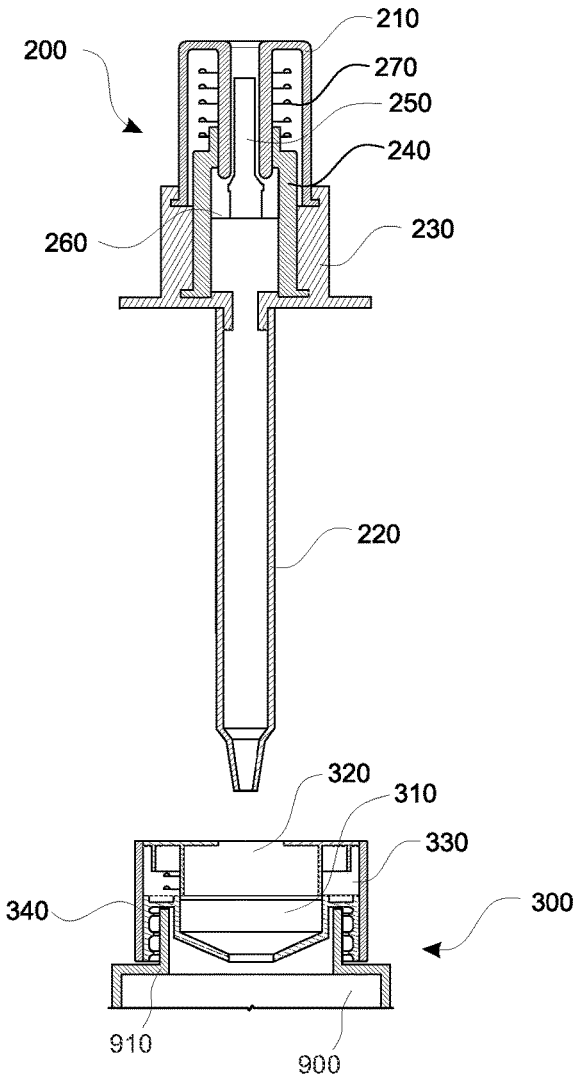
FIG. 5 illustrates a cross-sectional view of a dispensing system according to various embodiments of the invention.

According to various embodiments of the invention, a collar 300 may include a closure 310 fitted around and in an opening in a container 900. As illustrated in FIG. 5, a closure 310 may include a cylindrical wall having threading on an internal surface of the cylindrical wall, a cup interior of the cylindrical wall, and a bridge connecting the cup to the cylindrical wall. The cylindrical wall may be seated outside a threaded flange 910 of the container 900 and the cylindrical wall may include corresponding threads allowing the closure 310 to be screwed onto or fastened to the threaded flange 910 of the container 900. The cylindrical wall may define an outer circumference of the closure 310.

In some alternative embodiments, an interior surface of the cylindrical wall of the closure 310 may be configured with conventional bayonet or snap-on connection features (not shown) and the container 900 may include a flange or bottle opening having corresponding bayonet or snap-on features which allow the closure 310 to be attached to the container 900.

In various embodiments of the invention, the cup of the collar 300 may include an opening within the cup, providing an opening into an interior of a container 900 when the collar 300 is attached to a container 900.

A collar 300 may also include a collar cap 320 seated over the closure 310. A collar spring 330 may be seated between the closure 310 and the cap 320. A cap 320 according to certain embodiments of the invention is illustrated in FIG. 5, where such cap 320 may include a flat, circular upper portion having an opening therein. A cylindrical body portion extending off of an underside of the upper portion of the cap 320 may be configured to fit or be inserted into an interior portion of the closure 310. An outer cylindrical body portion may extend off of an underside of the upper portion of the cap 320 wherein the diameter of the outer cylindrical body portion is greater than a diameter of the cylindrical body portion of the cap 320. A spring 330 may be seated in a position between the cylindrical body portion of the cap 320 and the outer cylindrical body portion of the cap 320 and may extend downward to engage a surface of the closure 310.

According to various embodiments of the invention, a collar cap 320 may include a cam-lock closure system which allows the collar cap 320 to be locked with a dropper 200 and to be unlocked with respect to a dropper 200. This allows a user to fix a dropper 200 on the collar 300 until use is desired at which time the cam-lock system may be engaged to release the dropper 200 from the collar 300. In some embodiments, a collar cap 320 and a shroud 340 may include features that allow the collar cap 320 to retain or discharge a dropper 200.

A collar 300 may also include a shroud 340 as illustrated in FIG. 5. The shroud 340 illustrated has a cylindrical shape but shrouds 340 according to other embodiments of the invention may be any desired shape. As illustrated, the shroud 340 is configured around the closure 310, the cap 320, and the spring 330. The shroud 340 may be configured with a diameter or inner area to allow movement of the cap 320 relative to the inner surface of the shroud 340. In various embodiments of the invention, the closure 310 may be fixed to or connected to the closure 310. In other embodiments of the invention, the closure 310 and shroud 240 may be integrated or formed as a single component, for example, they may be molded as a single component. In some embodiments of the invention, the shroud 340 may be decorative or may include metal or other materials to give the shroud 340 a higher-end appearance.

A dropper 200 according to certain embodiments of the invention is illustrated in FIG. 5. As illustrated, a dropper 200 may include a dropper base 230, a tube 220 attached or fixed to the dropper base 230, and an actuator 210 and actuation system integrated with the dropper base 230 which may create a vacuum in the tube 220 when the actuator 210 is actuated The actuation system may include an accumulator 240, a piston 260 attached to a piston stem 250 and a spring 270.

As illustrated in FIG. 5, a dropper base 230 may include circular base portion having a dropper wall extending away from a top surface of the circular base portion. A tube connector may extend away from a bottom surface of the circular base portion and an opening through the circular base portion may be defined, at least in part, by the tube connector. While the dropper base 230, and in particular the circular base portion, illustrated in various embodiments of the invention is shown as being circular in shape, it is understood that other shapes and configurations may be used with various embodiments of the invention.

According to certain embodiments of the invention, an accumulator 240 may be seated on the dropper base 230 such that an interior portion of the accumulator 240 is in communication with the opening through the circular base portion of the dropper base 230. In some embodiments, an accumulator 240 may include a cylindrical component fastened to or seated on the dropper base 230 as illustrated in FIG. 5. An accumulator 240 may include openings in both ends, a first opening adjacent to the circular base portion of the dropper base 230 and a second opening opposite the first opening.

A piston 260 and piston stem 250 may be assembled with the accumulator 240 such that the piston 260 is located or contained with an interior space within the accumulator 230 between the first and second openings thereof. The piston 260 may be movable within the interior space of the accumulator 240 such the movement of the piston 260 may change the pressure in the interior space of the accumulator 240, facilitating the dispensing of a product out of such interior space or creating a vacuum to draw product into a tube 220 in fluid communication with such interior space. A piston stem 250 may be attached to the piston 260 and may be configured to assist with the movement of the piston 260 within an interior space of the accumulator. While various embodiments of the invention are illustrated and described as having both a piston 260 and a piston stem 250, in some embodiments of the invention the piston 260 and piston stem 250 may be a singular component. For example, a piston 260 and piston stem 250 combination may be molded as a single component and used with various embodiments of the present invention.

According to certain embodiments of the invention, an actuator 210 may be attached to or in communication with the piston stem 250 or piston 260 to facilitate movement of the piston 260 within the accumulator 240. Upon actuation of the actuator 210—or the application of a force thereto—the actuator 210 may cause the movement of the piston 260, the piston stem 250, or both.

An actuator 210 according to various embodiments of the invention is illustrated in FIG. 5. As illustrated, an actuator 210 may include an exterior wall, such as a cylindrical wall, extending away from an actuator surface. The exterior wall of an actuator 210 may be configured or shaped to fit within an interior space of the dropper base 230 defined by a dropper wall. The exterior wall of an actuator 210 may also be configured to fit around an exterior surface of an accumulator 240. An interior wall or post associated with the actuator 210 may be configured to engage a piston 260, a piston stem 250, or both as illustrated.

According to various embodiments of the invention a spring 270 may be positioned between an accumulator 240 and an interior portion of the actuator 210 such that the spring 270 applies a force on the actuator 210 tending to push the actuator 210 away from the accumulator 240. When a force is applied to a top exterior surface of the actuator 210 the spring 270 is compressed and the actuator 210 moves a piston stem 250, piston 260, or both within the accumulator 240. Upon release of such force, the spring 270 pushes the actuator 210 away from the accumulator 240, causing movement of the piston 260 within the accumulator 240. Such movement of the piston 260 in the accumulator 240 may push fluid out of the accumulator 240 or pull or draw fluid into the accumulator 240.

According to certain embodiments of the invention, a tube 220 may be made of glass, plastic, resin, or any other desired material and may be attached to the dropper base 230. For example, as illustrated in FIG. 5, a tube 220 may be attached to a tube connector extending off of the dropper base 230. While the illustrated embodiment shows a tube 220 attached with the tube connector on an interior of the tube 220, a tube 220 may also be connected wherein the tube connector is on an outer surface of the tube 220. In addition, other embodiments may include other conventional attachment features to facilitate the retention of a tube 220 to the dropper base 230.

Figure 6A:
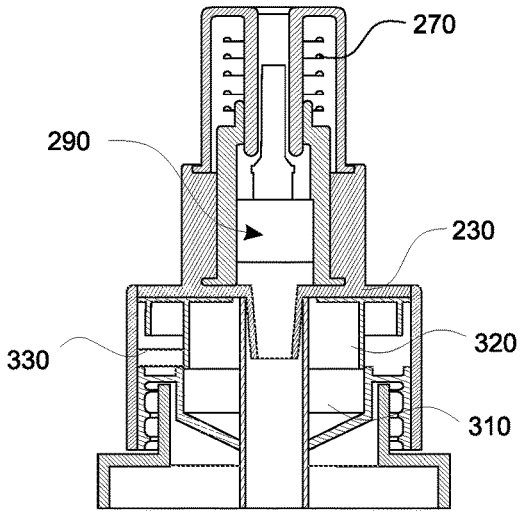
FIG. 6A illustrates a cross-sectional view of a dispensing system in a rest state according to various embodiments of the invention.
Figure 6B:
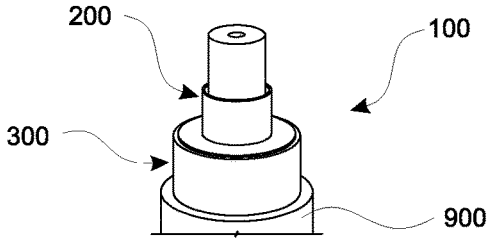
FIG. 6B illustrates a perspective view of the dispensing system illustrated in FIG. 6A.

FIGS. 6A through 9B illustrate the operation of a dispensing system 100 according to certain embodiments of the invention. As illustrated in FIG. 6B, a dispensing system 100 may include a dropper 200 attached to a container 900 wherein the dropper 200 is seated on a portion of the collar 300. FIG. 6A illustrates a cross-sectional view of a dispensing system 100 in an initial or non-primed state according to certain embodiments of the invention. As illustrated, a fluid chamber 290 is defined within the accumulator 240 between a bottom surface of the piston 260 and piston stem 250 and the top surface of the dropper base 230 to which the accumulator 240 is attached. A fluid flow path exists between the fluid chamber 290 and an interior portion of the tube 220. The tube 220 extends off of the dropper base 230 and through an opening in the closure 310 and into an interior portion of the container 900. In some embodiments, a top surface of the circular base portion of the dropper base 230 may be flush or substantially flush with a top edge of the shroud 340 as illustrated when the dispensing system 100 is in a non-primed state or state ready for actuation.

Figure 7A:
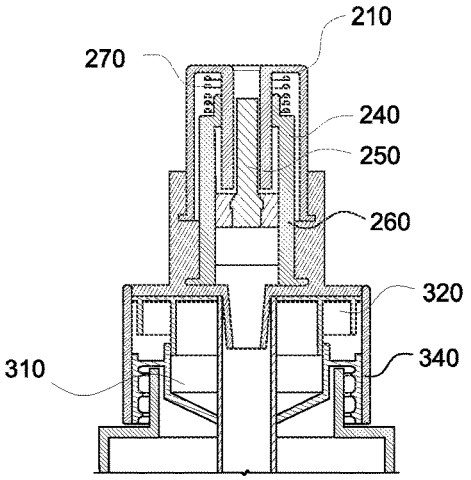
FIG. 7A illustrates a cross-sectional view of a dispensing system in a partially primed state according to various embodiments of the invention.

In order to prime the dispensing system 100 and draw product into an interior of the tube 220, the dropper 200 must be actuated. According to some embodiments of the invention the dispensing system 100 illustrated in FIGS. 6A and 6B may be actuated in accordance with the steps illustrated in FIGS. 7A through 9B. For example, the dropper 200 may first be actuated to evacuate the fluid chamber 290 as illustrated in FIG. 7A, Continued application of force on the actuator 210 may compress the collar spring 330 allowing the collar cap 320 to move relative to shroud 340 and engage a cam-lock system as illustrated in FIG. 8A. When the force on the actuator 210 is released the collar spring 330 releases, pushing the collar cap 320 up and releasing the connection between the collar 300 and the dropper 200 so that a user may remove the dropper 200 from the collar 300. In addition, the force on the dropper spring 270 is released, moving the piston 260, piston stem 250, or both upwards and away from the container 900, resulting in product being drawn from an interior of the container 900 into the tube 220 and possibly into the fluid chamber 290 of the dropper 200 as illustrated in FIG. 9A. The dropper 200 may then be removed from the collar 300 and the product contained in the tube 220, and any product contained in the fluid chamber 290, may be dispensed by a user. Dispensing of the product may be accomplished by pressing on, or applying a force to, the actuator 210, resulting in movement of the piston 260 and piston stem 250, which in turn forces product out of the fluid chamber 290 and interior of the tube 220.

Figure 7B:
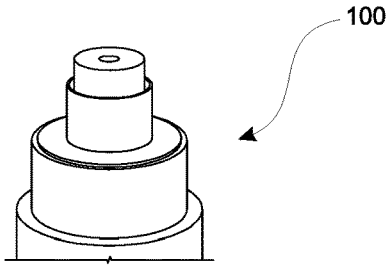
FIG. 7B illustrates a perspective view of the dispensing system illustrated in FIG. 7A.
Figure 8A:
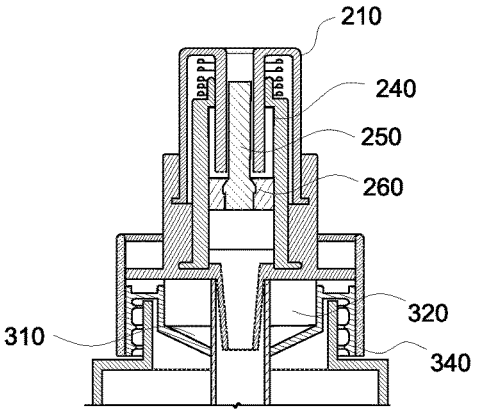
FIG. 8A illustrates a cross-sectional view of a dispensing system in a primed and unlocking state according to various embodiments of the invention.
Figure 8B:
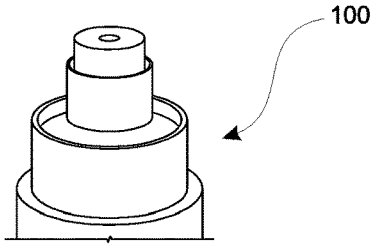
FIG. 8B illustrates a perspective view of the dispensing system illustrated in FIG. 8A.
Figure 9A:
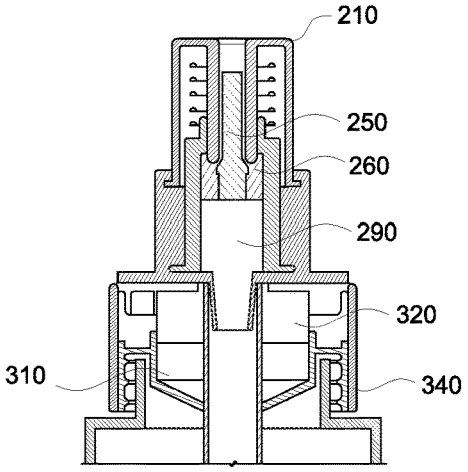
FIG. 9A illustrates a cross-sectional view of a dispensing system in a primed state according to various embodiments of the invention.
Figure 9B:
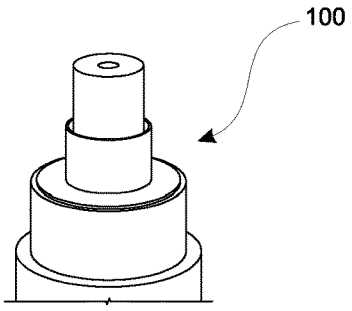
FIG. 9B illustrates a perspective view of the dispensing system illustrated in FIG. 9A.

FIGS. 7B, 8B, and 9B show external views of a dispensing system 100 being actuated according to various embodiments of the invention.

According to various embodiments of the invention, a dispensing system 100 as illustrated and described with respect to FIGS. 6A through 9B may be used with a conventional container 900 at atmospheric pressure. In such instances, the product may be exposed to air and product may be drawn from the bottom of the container 900 when the dropper 200 is actuated. In other embodiments of the invention, a dispensing system 100 may include an airless system and a container 900 having airless features such as a follower piston or piston for moving fluid and keeping air out of the system.

In some embodiments of the invention, the closure 310 includes an opening that also acts as a wipe or squeegee capable of wiping product off of the tube 220 as the tube 220 is inserted or removed from the dispensing system 100. For example, when a user removes a dropper 200 from the dispensing system 100 illustrated in FIG. 9A the dispensing system 100 illustrated in FIG. 5 results. As the dropper 200 is removed from the collar 300, the tube 220 may rub against the opening in the closure 310 such that any fluid on an exterior surface of the tube 220 in the container 900 is wiped away by the edge of the closure 310 opening, resulting in a substantially clean tube 220 being removed from the dispensing system 100 with the dropper 200 for use by a user.

In other embodiments of the invention, the opening in the cap may act as a wipe or squeegee capable of wiping product off of the tube 220 as the tube 220 is inserted or removed from the dispensing system 100.

Figure 10:
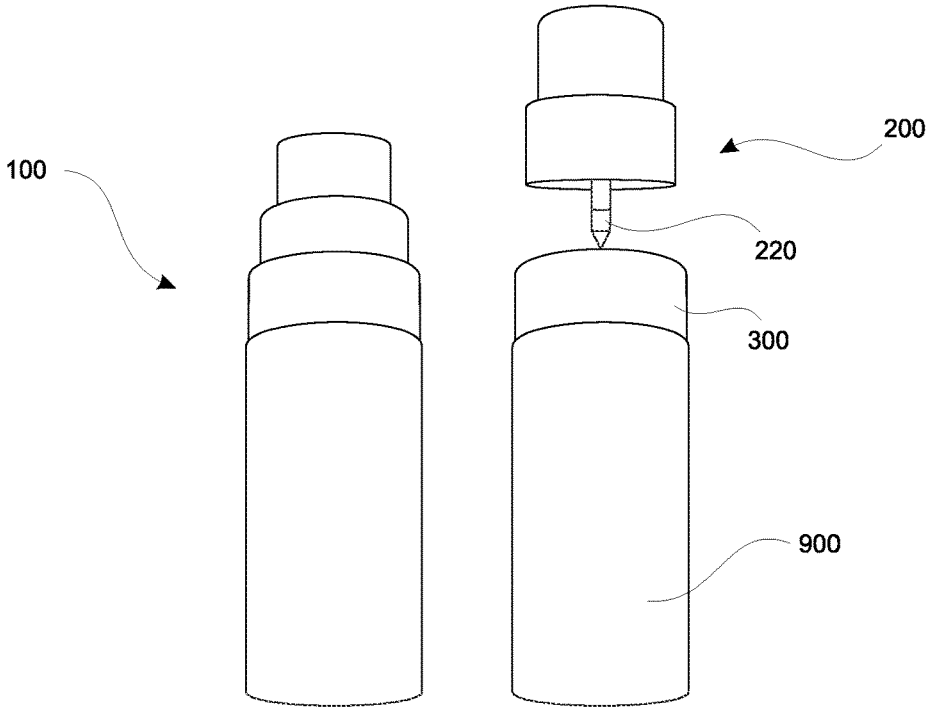
FIG. 10 illustrates an assembled and a disassembled dispensing system according to various embodiments of the invention.
Figure 11:
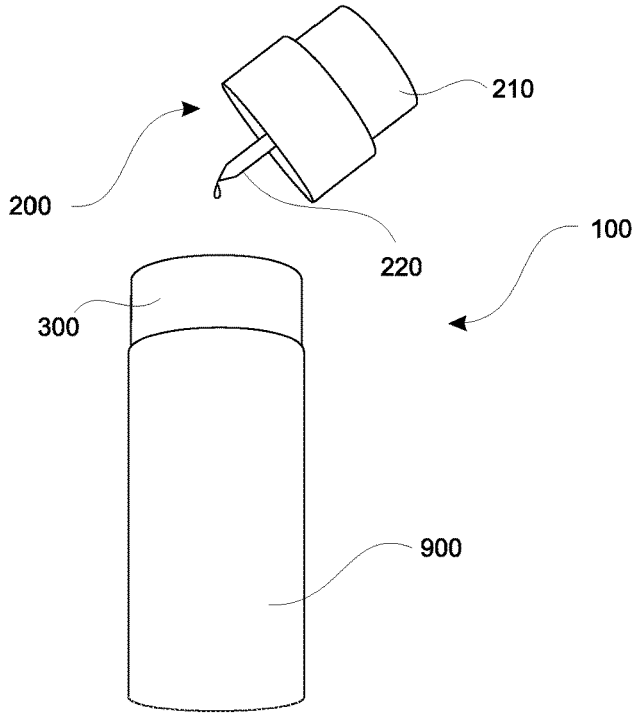
FIG. 11 illustrates a dispensing system and dropper in an actuated state according to various embodiments of the invention.

An alternative embodiment of a dispensing system 100 according to various embodiments of the invention is illustrated in FIGS. 10 and 11. As illustrated, a dropper 200 may include a short tube 220. In some instances, it may be desirable to have a short tube 220 that limits the amount of product that can be dispensed by a dropper 200 during any single use. In addition, the tube 220 length may be customized for the application for which the dropper 200 is to be used. In addition, the tube 220 may be customized to provide a fixed dose each time the dropper 200 is actuated.

As illustrated in FIG. 10, the dropper 200 may be actuated by pushing down on the actuator 210 to prime and charge the dropper 200—or tube 220 and fluid chamber 290 of the dropper 200—with product from the container 900. Continued actuation of the actuator 210 releases the dropper 200 from the collar 300 and container 900 so that it can be utilized by a user to dispense product. As illustrated in FIG. 11, as the actuator 210 of the dropper 200 is actuated when the dropper 200 is separated from the collar 300, such actuation causes the dropper 200 to dispense product from the tube 220.

Figure 12:
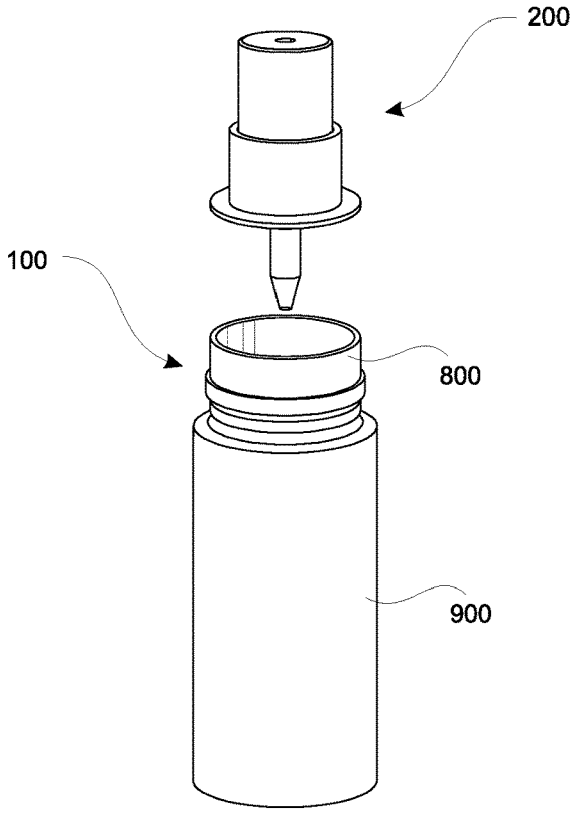
FIG. 12 illustrates a perspective view of a dispensing system having a container and dropper according to various embodiments of the invention.
Figure 13:
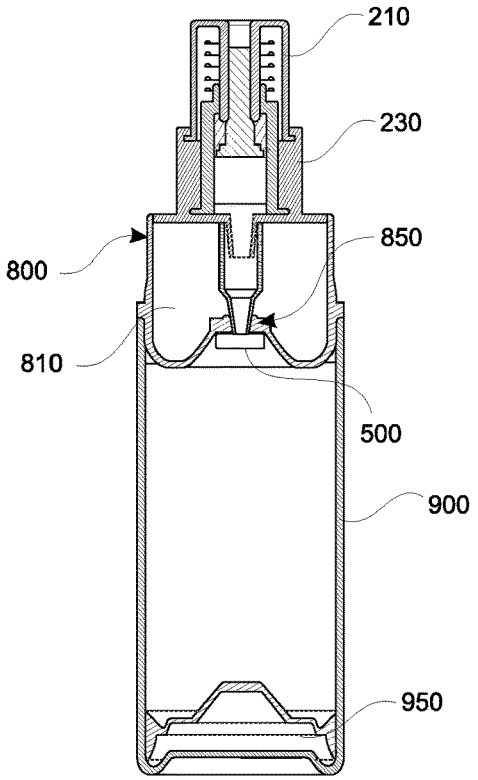
FIG. 13 illustrates a cross-sectional view of a dispensing system according to various embodiments of the invention.

A dispensing system 100 according to still other embodiments of the invention is illustrated in FIGS. 12 and 13. As illustrated in FIG. 12, a dispensing system 100 may include a container 900, a collar 800 attached to the container 900, and a dropper 200 that may mate with or interact with the collar 800 to remove product from the container 900.

A cross-sectional view of the dispensing system 100 illustrated in FIG. 12 is illustrated in FIG. 13. As illustrated, the dispensing system 100 may be of the airless type, having a container 900 with a piston follower 950 contained therein. The embodiment of the container 900 and piston follower 950 of the airless system illustrated in FIG. 13 is similar to conventional systems and operates in a similar manner as such conventional systems. However, the collar 800 is unique.

According to certain embodiments of the invention, a collar 800 utilized with an airless dispensing system 100 according to various embodiments of the invention may include a cup connector 810 seated in or fixed to the container 900 as illustrated. The cup connector 810 may be configured or shaped such that when assembled to a container 900 on a fill line, little or no air is trapped or retained in the container 900 with the product. In some embodiments, the cup connector 810 may be snap-fit to the container 900. In other embodiments it may be screwed onto, compression fit against, or otherwise attached to the container 900. In some embodiments, a cup connector 810 may include cylindrical walls extending from a lower base portion. The cylindrical walls may include features to allow a cap to be fastened to the collar 800 such that a cap may be fitted over a dropper 200 that is attached to, or resting on, the collar 800.

In certain embodiments of the invention, the cup connector 810 may include a valve seat 850. A surface of the cup connector 810 adjacent the interior of the container 900 may include one or more valve attachments to which a valve 500 may be attached or seated. In some embodiments, a valve 500 may be formed with the cup connector 810. In other embodiments, a valve 500 may be attached to or seated on the cup connector 810 as illustrated. In some embodiments, a valve 500 may include a valve system made up of multiple components.

According to some embodiments of the invention, a tube 220 of a dropper 200 may seat in a portion of the cup connector 810 adjacent the valve seat 850. An opening in the tube 220 may or may not contact a valve 500 seated in the valve seat 850. Upon actuation of the dropper 200, the valve 500 may prevent air from being forced into the container 900 where it may contaminate a product stored therein. However, upon release of the actuator 210, the vacuum formed by the retreating piston 260, piston stem 250, or both, may open the valve 500, allowing product to pass through the valve 500 and into the tube 210. As product is drawn from an interior of the container 900 through the valve 500 and into the tube 220, the piston follower 950 in the container 900 may move up to fill in the space vacated by the product in the container 900 in a conventional manner.

Figure 14:
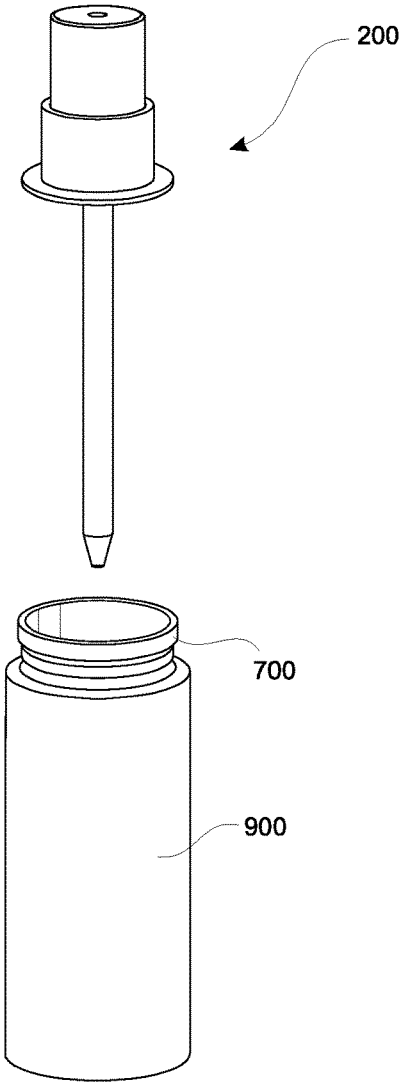
FIG. 14 illustrates a perspective view of a dispensing system having a container and dropper according to various embodiments of the invention.
Figure 15:
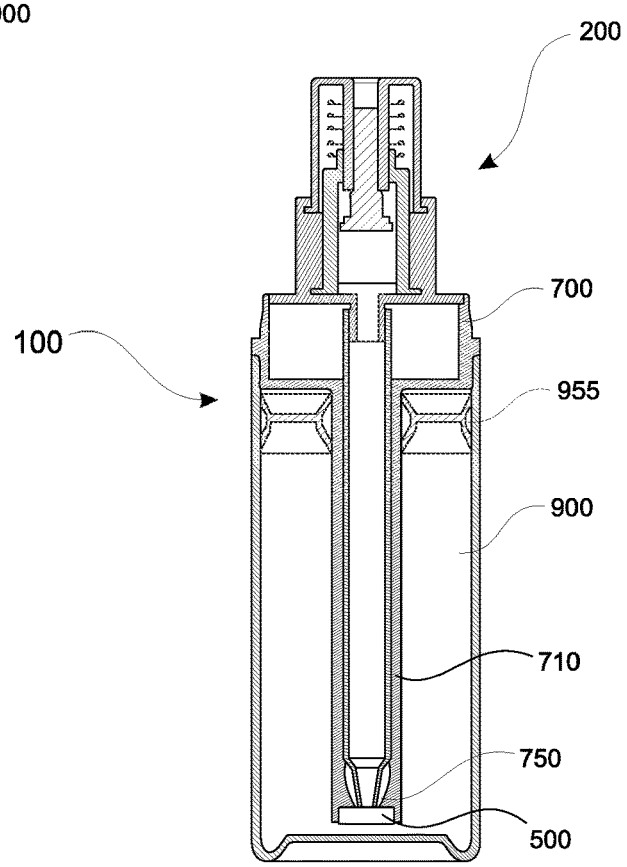
FIG. 15 illustrates a cross-sectional view of a dispensing system according to various embodiments of the invention.

A dispensing system 100 according to still other embodiments of the invention is illustrated in FIGS. 14 and 15. As illustrated, a dispensing system 100 may include a dropper 200, a container 900, and a collar 700. The container 900 may be configured as an airless container system, having a container piston 955 seated against the interior container 900 walls.

According to some embodiments, a collar 700 may include a collar base having a cylindrical—or other shaped—wall extending in one direction away from the collar base. A tube sleeve 710 may extend away from the collar base in a direction opposite the cylindrical wall. The tube sleeve 710 may be configured to receive a tube 220 of a dropper 200. An opening in the collar base is formed at the intersection of the collar base and the tube sleeve 710. The opposite end of the tube sleeve 710 includes a product opening and a valve seat 750. The valve seat 750 may be configured to receive and retain a valve 500 or a valve system to allow product to be drawn into the tube 220 during use of the dispensing system 100. The valve seat 750 and opening in the tube sleeve 710 may be adjacent a bottom of the container 900 as illustrated.

A container piston 955 may be fitted around the tube sleeve and may be fixed adjacent the collar base in an initial position. As product is removed from the container 900, the container piston 955 may move down the tube sleeve 710. In certain embodiments, a collar 700 may be fitted with a container piston 955 for assembly to a container 900 filled with product on an assembly line. A space between the container piston 955 and the collar base may be left such that when the collar 700 and container piston 955 combination are assembled to a container 900 containing product, the container piston 955 may move to adjust for the amount of product in the container 900. In this way, the container piston 955 may be positioned to accommodate different filling levels or standard errors and deviations in fill levels while still providing an airless system.

According to certain embodiments of the invention, when a dropper 200 of a dispensing system 100 illustrated in FIGS. 14 and 15 is actuated, air within the tube 220 and fluid chamber 290 is evacuated from therein. The valve 500 or valve system may prevent the evacuated air from entering the container 900. Upon release of the actuation, a vacuum is formed, drawing or pulling product from an interior of the container 900 through the valve 500 and into the tube 220. As product is withdrawn from the container 900, the container piston 955 moves down the tube sleeve 710, replacing the volume of space lost by product being evacuated from the container 900. The dropper 200 may then be withdrawn from the collar 700 as illustrated in FIG. 14 and a user may dispense the product from the dropper 200 by actuating the dropper 200.

Figure 16:
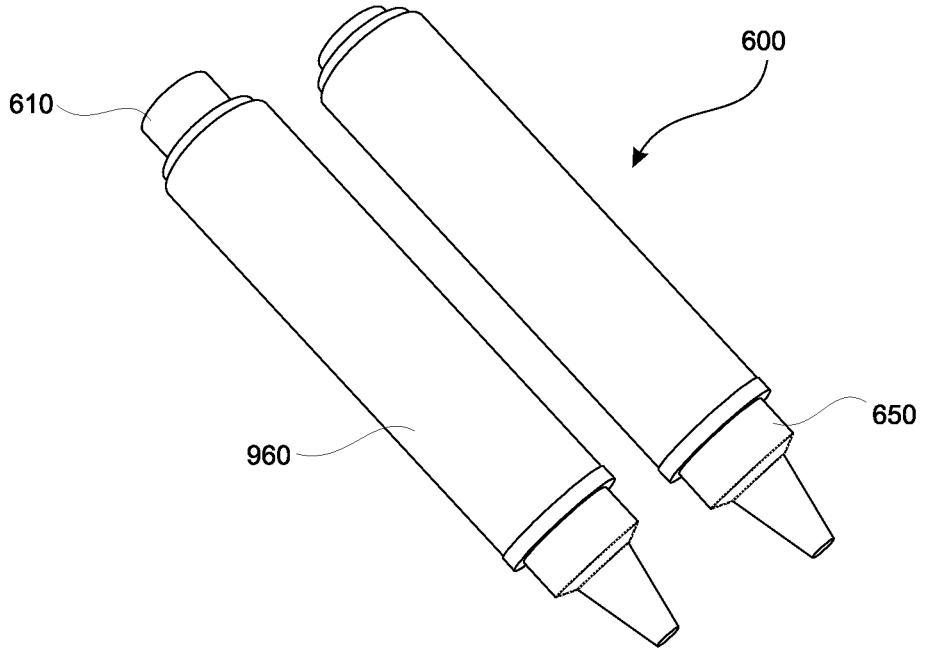
FIG. 16 illustrates a non-actuated and an actuated dispensing system according to various embodiments of the invention.
Figure 17:
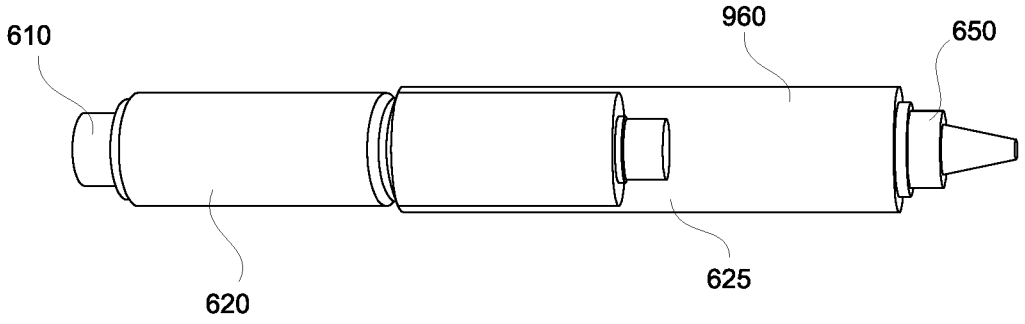
FIG. 17 illustrates a dispensing system according to various embodiments of the invention.

A dispensing system 600 according to still other embodiments of the invention is illustrated in FIGS. 16 and 17. As illustrated, a dispensing system 600 may include a container 960, a tip 650 connected to the container 960 at one end, and a product dispenser 620 inserted into an interior of the container 960. An actuator 610 may be integrated with the product dispenser 620 at one end thereof. A dispenser connection 625 may be positioned at the end of the product dispenser 620 opposite the actuator 610.

According to various embodiments of the invention, a product dispenser 620 may be inserted into a container 960 such that the dispenser connection 625 connects to the tip 650 so that product may be distributed from the product dispenser 620 out through the tip 650. As a user actuates the actuator 610, product contained in the product dispenser 620 is forced out of the tip 650 as illustrated in FIG. 16.

According to various embodiments of the invention, the dispensing system 600 may be used as a refill system. Different product dispensers 620 may be fitted into the container 960 as desired by a user to distribute the product of their choice. In other embodiments, a product dispenser 620 may lock with the tip 650 when first inserted such that the dispensing system 600 becomes a package into which refills may not be added. In such instances, once a user has evacuated the product dispenser 620 the package is empty and cannot be refilled.

Figure 18:
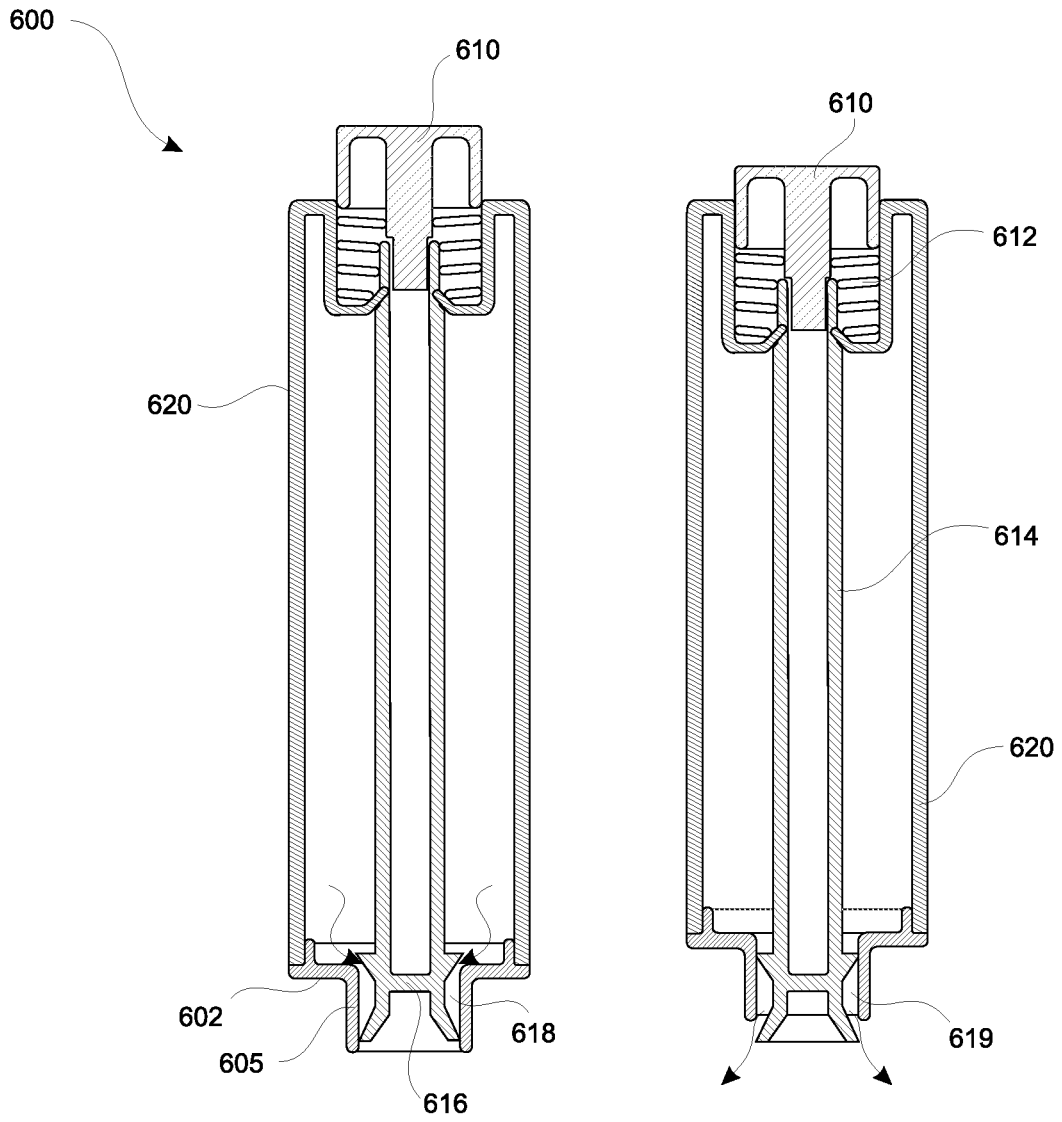
FIG. 18 illustrates a dispensing system according to various embodiments of the invention in a non-actuated and an actuated state.

According to other embodiments of the invention, a product dispenser 620 may include a product dispenser 620 shell configured to accept an actuator 610 as illustrated in FIG. 18. A spring 612 may be seated between an interior of the actuator 610 and an exterior of the product dispenser 620 shell as illustrated in FIG. 18. A piston rod 614 may be connected to the actuator 610 at one end and may have a valve plug 616 at an opposite end. The valve plug 616 may be seated in a valve seat 605 of a plug 602 attached to an end of the product dispenser 610. The valve plug 616 may include two or more flanges defining a space between the flanges when the flanges are adjacent a surface.

The valve plug 616 may be moved as the actuator 610 is moved. According to embodiments of the invention, when the valve plug 616 is in a non-actuated position a first flange of the valve plug 616 is engaged with or sealed to a surface of the plug 602. An at-rest space 618 is defined between the valve plug 616 and the plug 602 in this position. When the product dispenser 620 is actuated, the piston rod 614 moves, moving the valve plug 616 such that the second flange engages the wall of the plug 602. Continued movement allows the first flange to disengage from the plug 602 wall surface such that product contained in the fluid space 619 may be released from the product dispenser 620.

Figure 19:
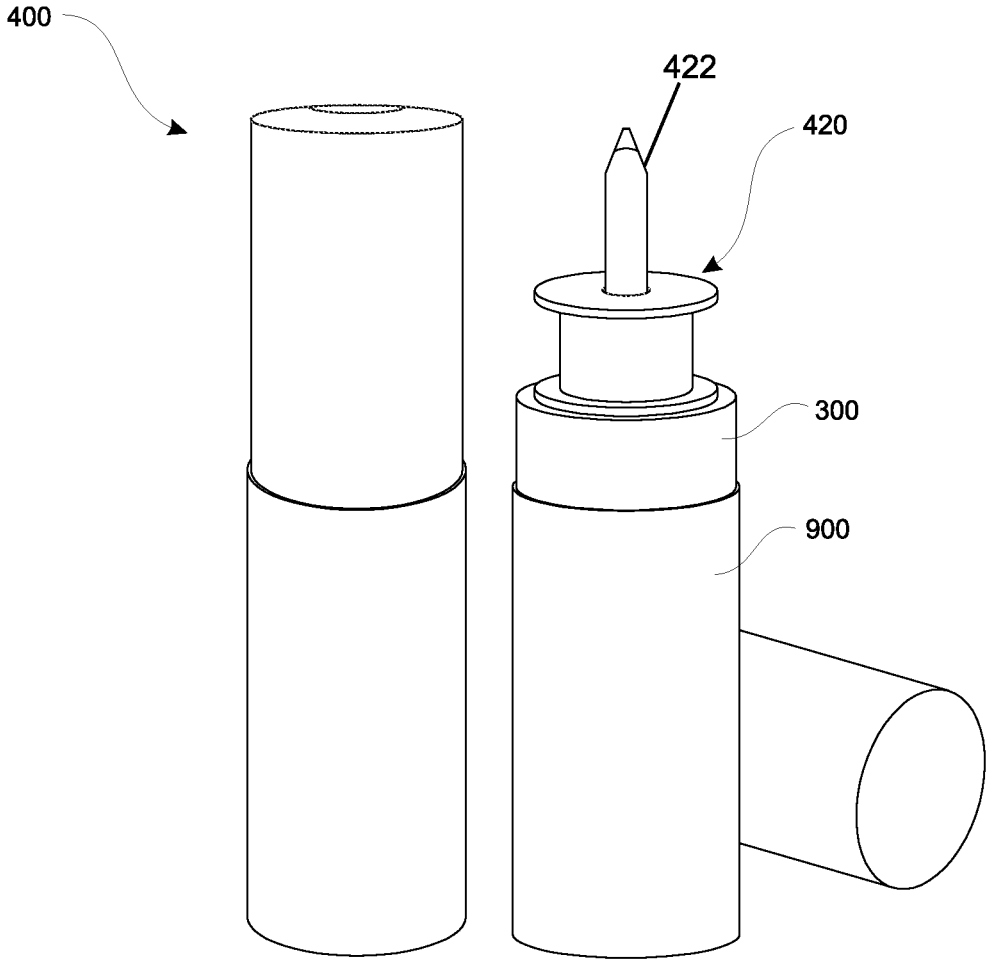
FIG. 19 illustrates a dispensing system according to various embodiments of the invention.
Figure 20:
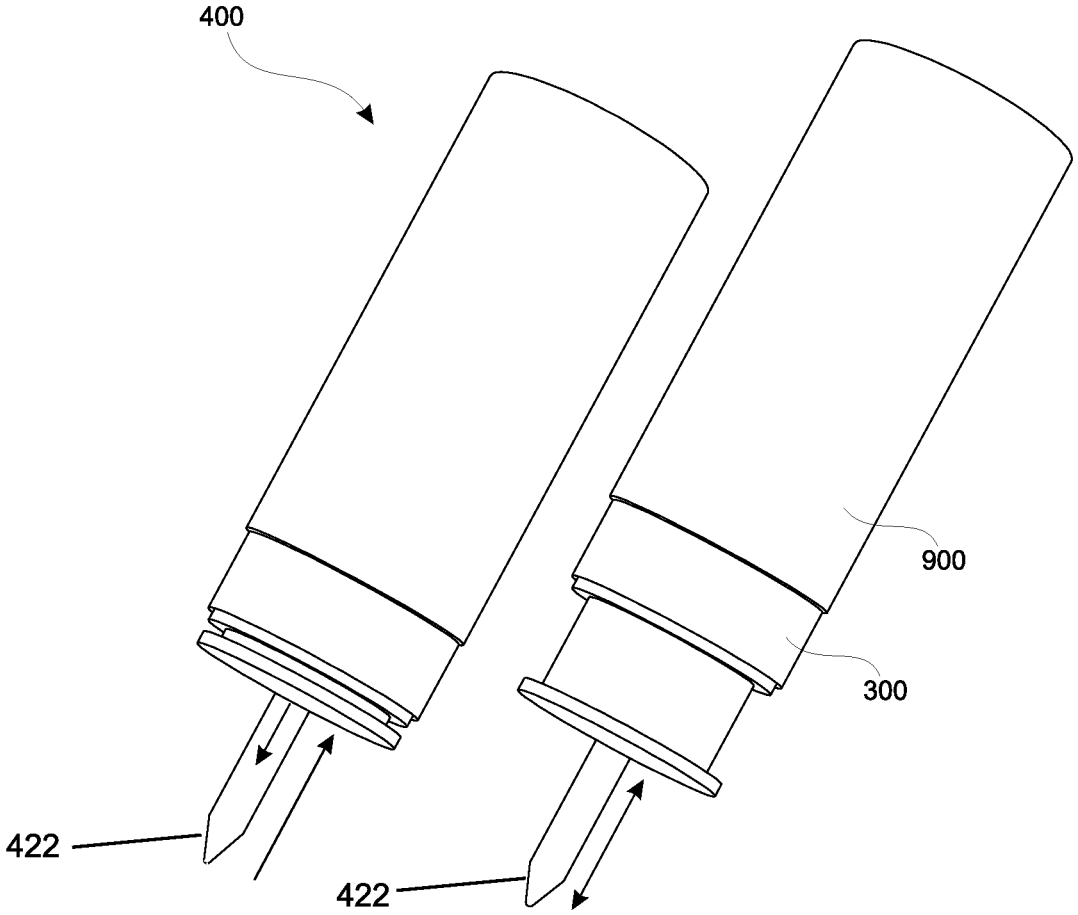
FIG. 20 illustrates dispensing systems according to various embodiments of the invention in a primed and an actuation configuration.

According to still other embodiments of the invention, a dispensing system 400 may include a container 900, a collar 300, and a dispenser 420 connected to the collar 300 as illustrated in FIGS. 19 and 20. A tube 422 may extend from the dispenser 420. In operation, the dispenser 420 may be actuated by applying a force to the dispenser 420 or a surface thereof. As the dispenser 420 is actuated, product from an interior of the container 900 is loaded into the tube 422.

According to some embodiments of the invention, a product in the tube 422 of the dispenser 420 may be release and dispensed as the force on the dispenser 420 is released. In other embodiments of the invention, the force on the dispenser 420 may be released and the product retained in the tube 422 until a second force is applied to the dispenser 420 to dispense the product from the tube. In this manner, a first actuation of the dispenser 420 loads the tube 422 with product and a second actuation dispenses the product.

Having thus described certain particular embodiments of the invention, it is understood that the invention defined by the appended claims is not to be limited by particular details set forth in the above description, as many apparent variations thereof are contemplated. Rather, the invention is limited only be the appended claims, which include within their scope all equivalent devices or methods which operate according to the principles of the invention as described. In addition, it is understood that various components described with reference to a particular embodiment herein may be incorporated or included with other embodiments even if a description of such embodiments together is not illustrated or described.

What is claimed is:

1. A dispensing system, comprising:
a container;
a collar attached to the container, wherein the collar comprises:
a closure seated in an opening of the container;
a cap seated over the closure; and
a spring seated between the closure and the cap; and
a dropper configured for attachment to and separation from the collar, the dropper comprising:
a dropper base;
a tube attached to the dropper base; and
an actuator.

2. The dispensing system of claim 1,
wherein the closure comprises:
a cylindrical wall defining an outer circumference of the closure;
a cup positioned on an interior of the cylindrical wall; and
a bridge connecting the cylindrical wall and the cup;
wherein the cap comprises:
an upper portion,
an opening in the upper portion;
a cylindrical body portion extending off of an underside of the upper portion; and
an outer cylindrical body portion extending off of an underside of the upper portion,
wherein the diameter of the outer cylindrical body portion is greater than a diameter of the cylindrical body portion; and
wherein the spring engages an underside of the cap and an upper side of the closure.

3. The dispensing system of claim 2, wherein the cylindrical wall further comprises threading on an internal surface of the cylindrical wall.

4. The dispensing system of claim 2, wherein the cup further comprises an opening in a central portion of the cup.

5. The dispensing system of claim 4, wherein the tube fits through the opening in the upper portion of the cap and the opening in the central portion of the cup when the dropper is engaged with the collar.

6. The dispensing system of claim 5, wherein the opening in the upper portion of the cap engages the tube as the dropper is separated from the collar.

7. A dispensing system, comprising:
a container;
a piston follower seated in an interior of the container;
a cup connector fixed to the container and comprising a valve seat;
a valve seated in the valve seat, and
a dropper removeably attached to the cup connector, wherein the dropper comprises a dropper base and a tube attached to the dropper base, and wherein the tube is in contact with the valve when the dropper is affixed to the cup connector.

8. The dispensing system of claim 7, wherein the dropper further comprises:
a first opening in the dropper base;
a tube connection extending off a bottom surface of the dropper base around the first opening, an accumulator seated on an upper surface of the dropper base and surrounding the first opening;
a second opening in the accumulator opposite the first opening in the dropper base;
a piston seated in an interior space of the accumulator,
a piston stem attached to the piston and extending through the second opening;
an actuator attached to the piston stern;
a spring seated between the actuator and the accumulator; and
wherein the tube is attached to the tube connection.

9. A dispensing system, comprising:
a container;
a collar attached to an opening in the container, comprising a valve seat;
a valve seated in the valve seat;
a container piston seated about a portion of the collar; and
a dropper removeably attached to the collar, wherein the dropper comprises:
a dropper base,
a first opening in the dropper base;
a tube connection extending off a bottom surface of the dropper base around the first opening;
an accumulator seated on an upper surface of the dropper base and surrounding the first opening; a second opening in the accumulator opposite the first opening in the dropper base;
a piston seated in an interior space of the accumulator;
a piston stem attached to the piston and extending through the second opening;
an actuator attached to the piston stem;
a spring seated between the actuator and the accumulator; and
a tube attached to the tube connection.

10. The dispensing system of claim 9, wherein the collar further comprises:
a collar base;
an opening in the collar base,
a cylindrical wall extending away from the collar base in a first direction;
a tube sleeve extending away from the collar base in a direction opposite the cylindrical wall, the tube sleeve encompassing the opening in the collar base, wherein the valve seat is at an end of the tube sleeve opposite the opening in the collar base; and
wherein the container piston is seated on an exterior surface of the tube sleeve.

* * * * *